US007350824B2

(12) United States Patent
Petner et al.

(10) Patent No.: US 7,350,824 B2
(45) Date of Patent: Apr. 1, 2008

(54) DRAIN FITTING

(75) Inventors: Robert E. Petner, Burlington, NJ (US); Charles E. Gengler, South Orange, NJ (US)

(73) Assignee: Nicelife, Inc., Burlington, NJ (US)

( * ) Notice: Subject to any disclaimer, the term of this patent is extended or adjusted under 35 U.S.C. 154(b) by 105 days.

(21) Appl. No.: 11/181,357

(22) Filed: Jul. 14, 2005

(65) Prior Publication Data

US 2007/0013187 A1 Jan. 18, 2007

(51) Int. Cl.
*F16L 55/00* (2006.01)
*A47L 9/10* (2006.01)

(52) U.S. Cl. ..... 285/148.23; 285/8; 285/12; 15/353

(58) Field of Classification Search ..... 15/344, 15/323, 327, 353; 285/148.23, 145.2, 145.3, 285/146.1, 146.2, 147.3, 148.1, 331, 12, 285/8

See application file for complete search history.

(56) References Cited

U.S. PATENT DOCUMENTS 1,343,169 A * 6/1920 Douglass ..... 220/62.18
2,229,375 A * 1/1941 Eggleston ..... 4/255.08
2,238,541 A * 4/1941 Spagnolo ..... 15/397
2,535,092 A * 12/1950 Rettinger ..... 4/255.05
2,733,450 A * 2/1956 Wallace ..... 4/255.06
2,988,755 A * 6/1961 Roland ..... 4/654
3,029,463 A * 4/1962 Bishop ..... 15/353
4,736,473 A * 4/1988 Gellatly ..... 4/255.09
5,377,858 A * 1/1995 Morris, Sr. ..... 220/254.8
5,394,587 A * 3/1995 Parise ..... 15/353
5,813,702 A * 9/1998 McGuire ..... 285/148.23
D402,013 S * 12/1998 Saffrey ..... D23/263
6,189,550 B1 * 2/2001 Stickel et al. ..... 134/174
2002/0189046 A1 * 12/2002 Nighy ..... 15/327.1

* cited by examiner

*Primary Examiner*—Robert J. Sandy
*Assistant Examiner*—Jay R Ripley
(74) *Attorney, Agent, or Firm*—Stuart M. Goldstein

(57) ABSTRACT

A drain fitting has a unitary body with a lower section and an upper section upstanding from the lower section. The lower section encompasses a space and is open to the drain line to be cleaned. The upper section has a side wall and an inner wall which forms a channel. The inner wall encompasses a through passage which is open to the space encompassed within the lower section. A line of a given diameter can thus be received and maintained around the side walls. Another line of different diameter can be received and maintained within the channel and lines of other different diameters can be maintained within the through passage.

4 Claims, 5 Drawing Sheets

DRAIN FITTING

BACKGROUND OF THE INVENTION

Wet/dry vacuum cleaning systems are commonly used in commercial, industrial, and residential settings for cleaning and purging various types of drains and equipment, including piping, plumbing fittings and fixtures, drain and filter conduits, and many other fluid carrying systems, components and lines. Vacuum (suction) or positive pressure is normally applied by the system through lines. The lines typically are secured to a fitting, which connects the line with the drain or other area to be cleaned or purged.

The fittings now in use, regardless of their shape and irrespective of their means of attachment, each can only accommodate a line of a single diameter. A particular diameter fitting must be used with the same diameter sized line. This, of course, requires that many different fittings be provided with a given cleaning system which uses multiple sized lines. This results in the added expense of purchasing fittings and the inconvenience of transporting multiple fittings to a worksite or discovering that the right sized fitting is missing for the job at hand.

SUMMARY OF THE INVENTION

It is thus the object of the present invention to overcome the disadvantages and limitations of prior drain fittings by providing one drain fitting which is adaptable for use with a plurality of lines of varying diameter sizes. A single fitting can now receive and maintain many different sized lines, thus eliminating the need for the purchase of multiple fittings and the inconvenience associated with transporting many different fittings to accommodate different sized lines.

These and other advantages are accomplished by the present invention, a drain fitting which has a unitary body with a lower section and an upper section upstanding from the lower section. The lower section encompasses a space and is open to the drain line to be cleaned. The upper section has a side wall and an inner wall which forms a channel. The inner wall encompasses a through passage which is open to the space encompassed within the lower section. A line of a given diameter can thus be received and maintained around the side walls. Another line of different diameter can be received and maintained within the channel and lines of other different diameters can be maintained within the through passage.

Novel features which are considered as characteristic of the invention are set forth in particular in the appended claims. The invention itself, however, both as to its design, construction and use, together with the additional features and advantages thereof, are best understood upon review of the following detailed description with the reference to the accompanying drawings.

DETAILED DESCRIPTION OF THE INVENTION

Figure 1:
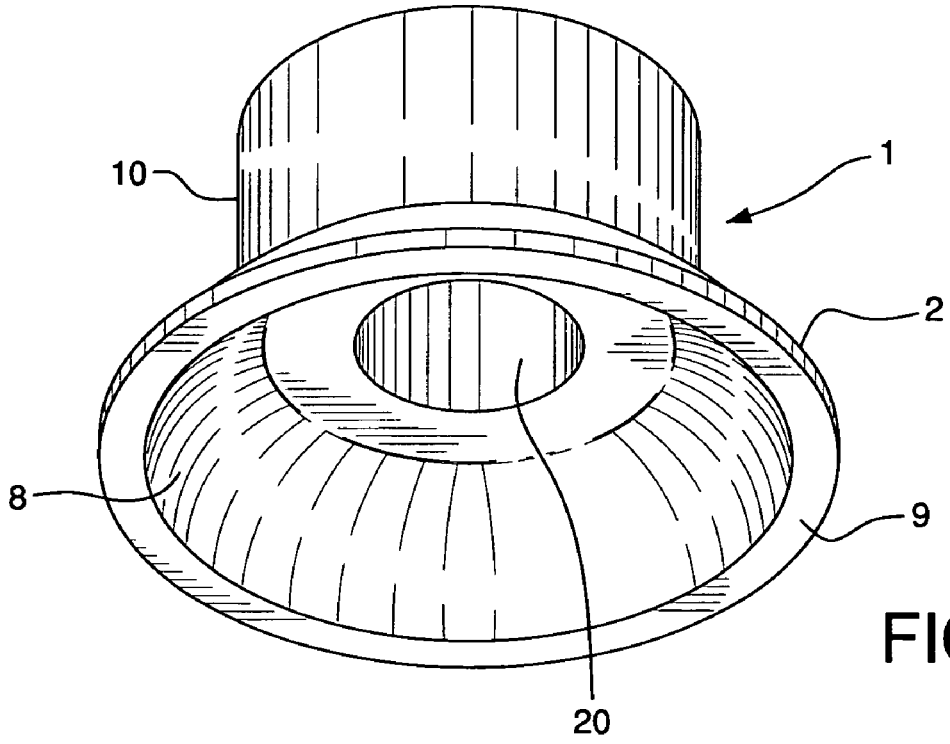
FIG. 1 is an isometric view of the drain fitting of the present invention showing the bottom regions of the fitting.
Figure 2:
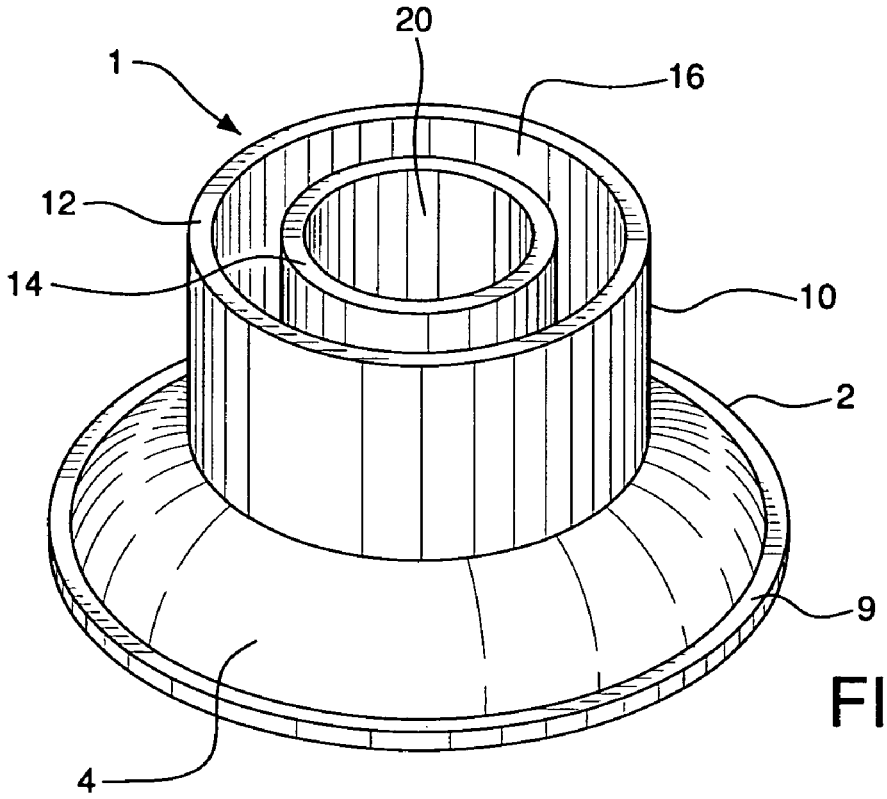
FIG. 2 is an isometric view of the drain fitting of the present invention showing the upper regions of the fitting.
Figure 3:
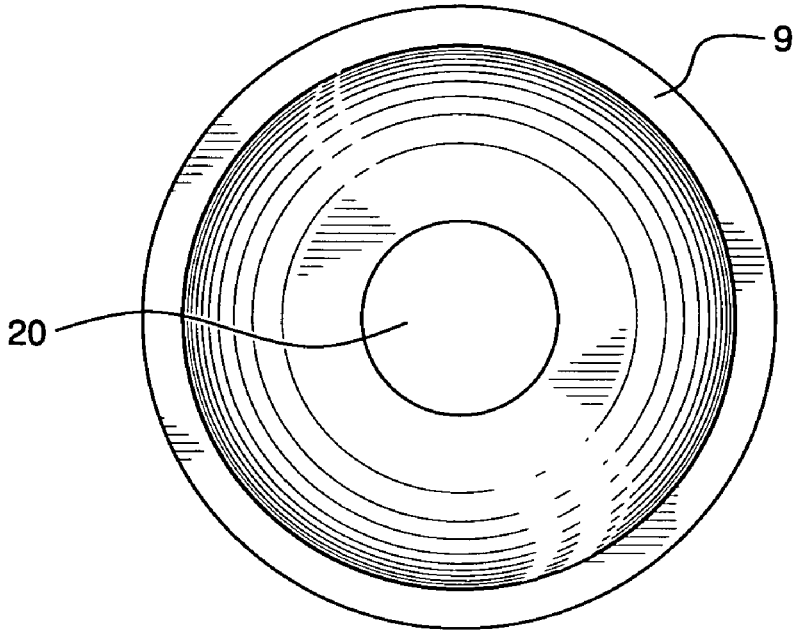
FIG. 3 is a bottom view of the drain fitting of the present invention.
Figure 4:
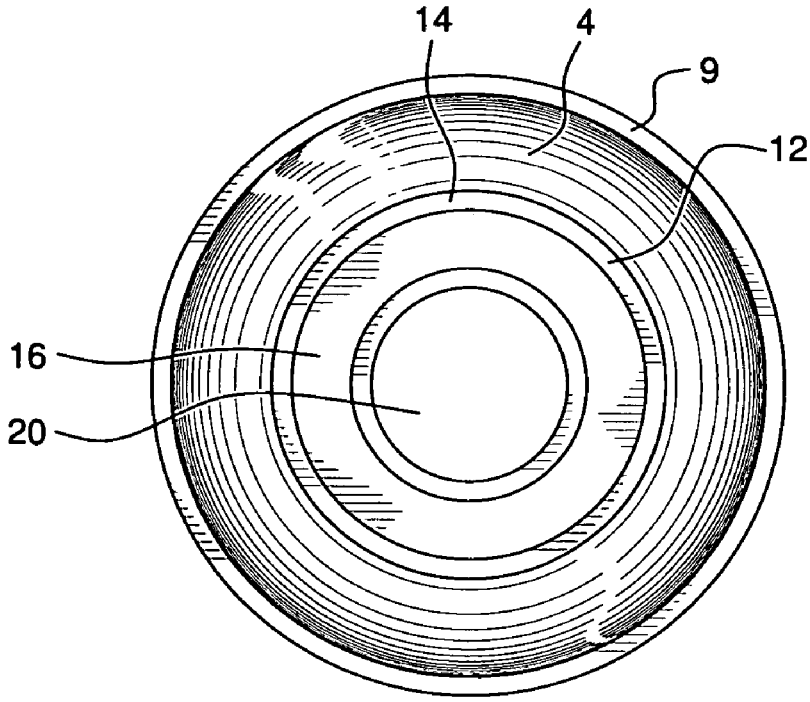
FIG. 4 is a top view of the drain fitting of the present invention.
Figure 5:
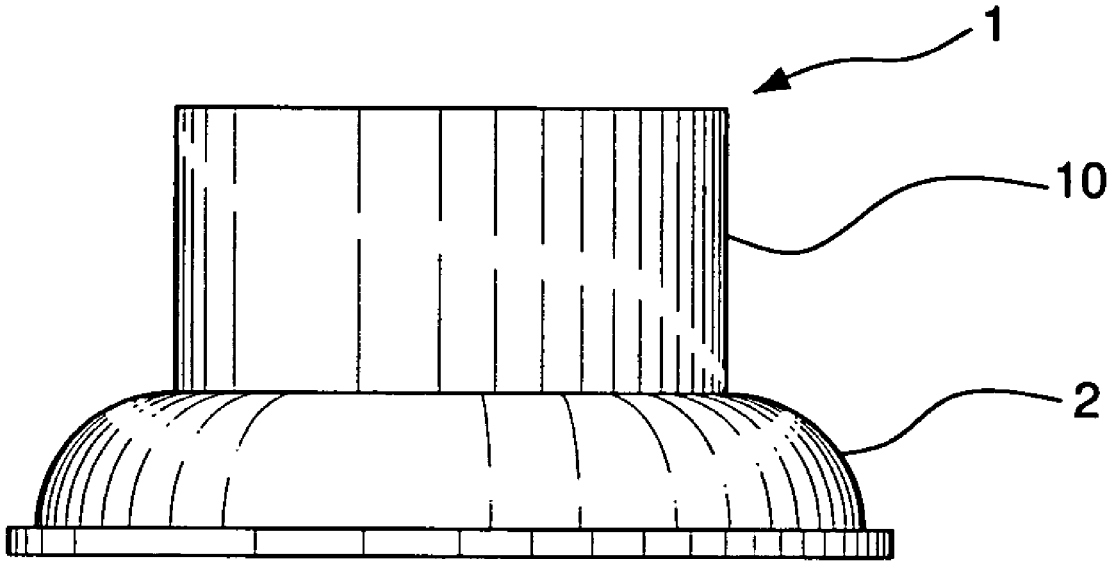
FIG. 5 is a side view of the drain fitting of the present invention.

Drain cleaning fitting 1 is an integral, unitary body comprising lower section 2 having outer wall 4. Wall 4 is curvilinear in nature and has its widest diameter at its bottom end. Wall 4 encompasses space 6 which, at its bottom end, comprises opening 8 which is configured to be placed over the area to which vacuum suction or pressure forces are to be applied. Lip 9 surrounds the bottom of lower section 2.

Upper section 10 is upstanding from lower section 2 and comprises vertically extending side wall 12 and vertically extending inner wall 14, both circular in configuration. Circular channel 16 is formed between side wall 12 and inner wall 14. Through passage 20, extending the length of upper section 10, is open at its top end and, at its bottom end, is open to space 6. See FIGS. 6-9.

In use, fitting 1 receives and maintains lines, such as lines 30, 32, 34 and 36 in place, as shown in FIGS. 6-9. The other ends of the lines are to be connected to a fluid vacuum or positive pressure source. When a vacuum is applied from the source, fluid is sucked through opening 8 of fitting 1. It then passes through space 6 into passage 20, eventually flowing to the discharge destination. When a positive pressure is applied, fluid enters passage 20, through space 6 and out opening 8.

Figure 6:
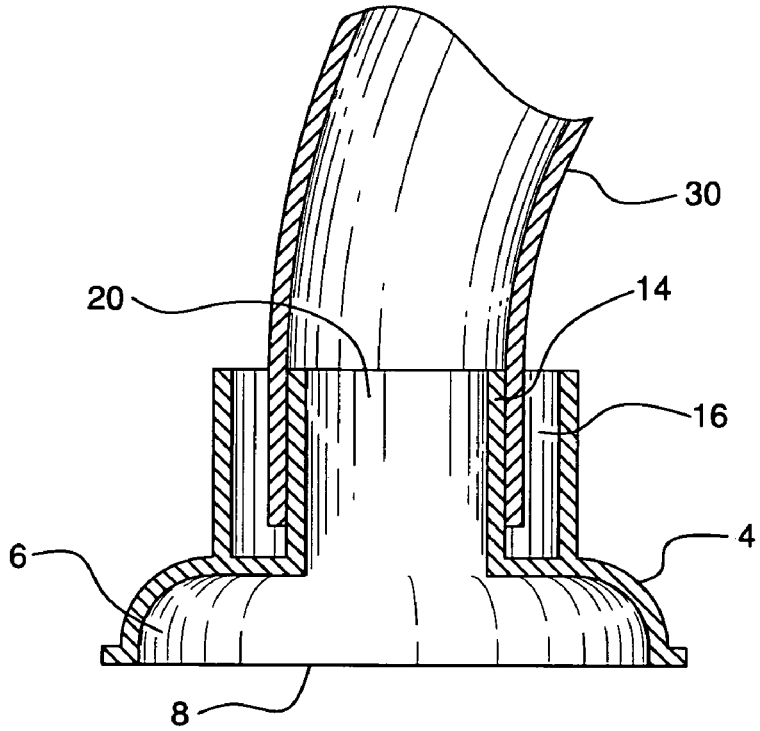
FIG. 6 is a cross-sectional view of the drain fitting of the present invention with a line inserted into the fitting.
Figure 7:
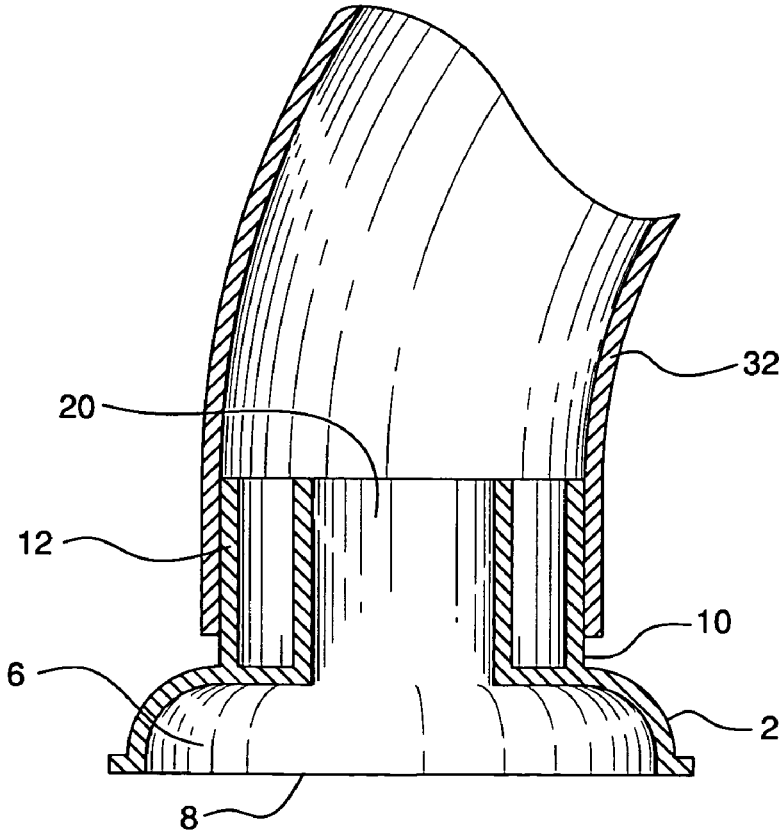
FIG. 7 is a cross-sectional view of the drain fitting of the present invention with a different diameter line inserted onto the fitting.
Figure 8:
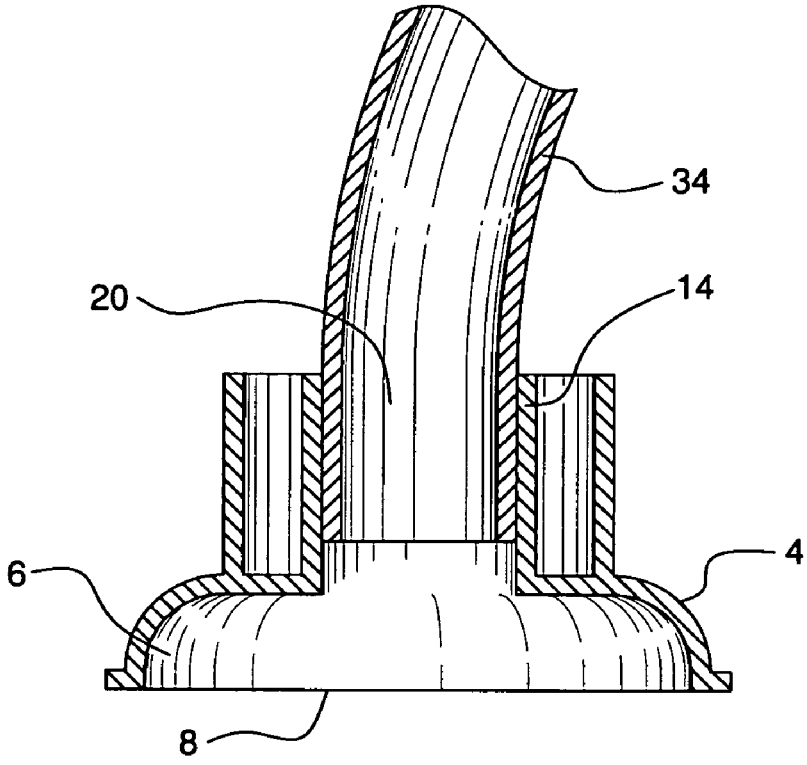
FIG. 8 is a cross-sectional view of the drain fitting of the present invention with still another diameter line inserted into the fitting.
Figure 9:
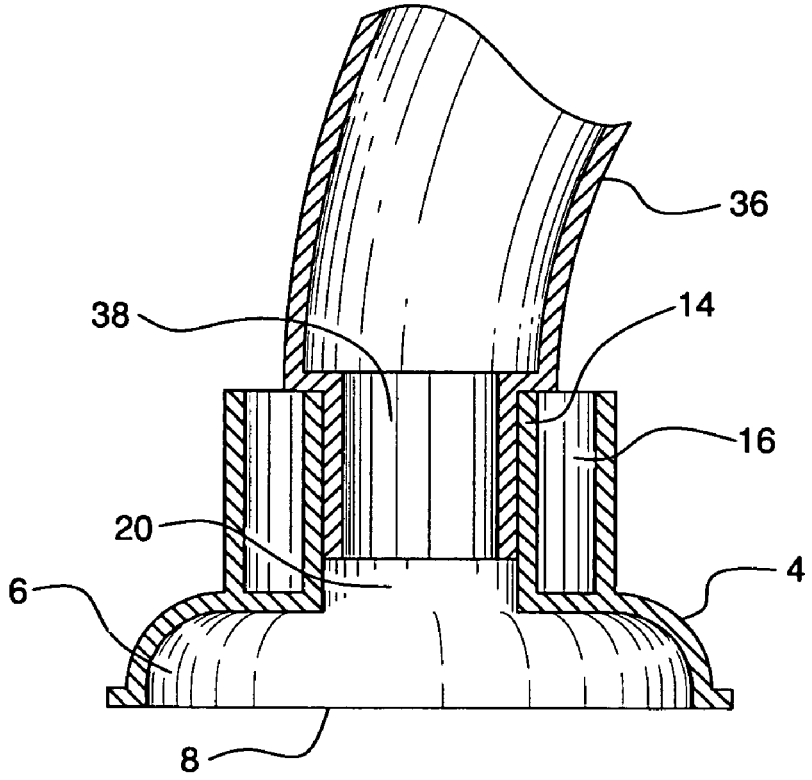
FIG. 9 is a cross-sectional view of the drain fitting of the present invention with still another diameter line inserted into the fitting.

As a result of fitting 1 of the present invention, vacuum suction and positive pressure lines of varying diameters can be receiving by and maintained on the fitting. For example, the diameter of line 30 shown in FIG. 6 is such that its end can be inserted around inner wall 14, within channel 16. The diameter of line 32 shown in FIG. 7 allows for its insertion on upper section 10, around side wall 12. FIG. 8 shows line 34 with a diameter which is sized to be inserted within through passage 20, adjacent to inner wall 14. Fitting 1 is also adaptable to receive lines with reduced diameter ends, such as line 36 shown in FIG. 9, whose end 38 is insertable into through passage 20, adjacent inner wall 14.

Thus it is seen that drain cleaning fitting 1 is quite versatile. This single fitting can be used in a system which employs a variety of diameter lines or with many systems which have lines of different diameters. One fitting can now be used where, in the past, many were needed.

It is anticipated that standard lines ranging from two and a half inches in diameter to an inch and a quarter in diameter will be used with the fitting of this invention. However, it is specifically stated that the subject invention is not to be considered restricted by size. The fitting can be configured with any desired outside and inside diameter dimensions.

In addition, the scope of the invention is not to be considered restricted by the shape of the fitting. The embodiment disclosed shows a fitting which is circular in nature, since most lines in pressure systems are circular. However, the fitting of this invention can be configured in any geometric shape, so as to conform with the shape of the line being used.

The unitary body of fitting 1 can be fabricated as a single hard plastic mold piece. It can also be made of hard rubber, molded plastic, or similar material.

Attachment of the vacuum/pressure lines to fitting 1 can be accomplished in a number of ways. For instance, for certain applications it will be enough to just insert resilient lines onto or into fitting 1 to form a snug fit over or in the fitting. Where a tighter and more fluid proof connection is required, line or hose clamps may be used. The outside or inside surfaces of side wall 12 and/or internal wall 14 can also be threaded, in order to provide a secure threadable connection between fitting 1 and the line to be attached.

Certain novel features and components of this invention are disclosed in detail in order to make the invention clear in at least one form thereof. However, it is to be clearly understood that the invention is disclosed is not necessarily limited to the exact from and details as disclosed, since it is apparent that various modifications and changes may be made without departing form the spirit of the invention.

The invention claimed is:

1. A drain fitting and vacuum and pressure line system for receiving and maintaining vacuum and positive pressures, said system comprising:

a drain fitting having an integral, unitary body, said unitary body comprising:

(a) a lower section comprising a curvilinear outer wall substantially uniform in thickness with a concave inner surface and a convex outer surface, said wall encompassing a space and substantially surrounding an opening means having a first width for the passage of vacuum suction and positive pressure forces, said space extending substantially the entire length of the lower section and being completely defined by and encompassed within the concave inner surface, the space comprising a finite area completely open between the concave inner surface and the opening means; and (b) an upper section upstanding from, and concentric to, the lower section said upper section being totally outside of and extending away from the space encompassed by the outer wall and having a second width smaller than the first width, said upper section comprising first and second concentrically aligned cylindrical segments of equal length, each said cylindrical segment having an outer surface which completely circumscribes the full length of the segment without outer surface interruption, each segment located outside of said space and extending the full length of the upper section; said upper section further comprising a through passage located within the second segment enclosed, without outer surface interruption, by the second segment, said passage extending the full length of said second segment and having two open ends, one end being open to the space; and a channel located between the first and second segments, said channel being enclosed, without surface interruption, by the first and second segments, and extending the full length of the segments and having one open end and one closed end proximal the convex outer surface; and at least one elongated, unitary length vacuum and positive pressure line independent of any separate line connector means, said line having an open end with a diameter which conforms in size to the upper section of the fitting, said open end of the line being in adjacent, co-joined, direct contact with the upper section of the drain fitting, forming a contiguous, direct joint between the vacuum and positive pressure line and the drain fitting independent of any intervening separate line connector means.

2. The drain fitting and vacuum and pressure line system as in claim 1 wherein the vacuum and positive pressure line end is located within the channel of the drain fitting.

3. The drain fitting and vacuum and pressure line system as in claim 1 wherein the vacuum and positive pressure line end is located outside the upper section of the drain fitting.

4. The drain fitting and vacuum and pressure line system as in claim 1 wherein the vacuum and positive pressure line end is located within the passage of the drain fitting.

* * * * *